US006471534B1

(12) United States Patent
Lee

(10) Patent No.: US 6,471,534 B1
(45) Date of Patent: Oct. 29, 2002

(54) ELECTRICAL CONTACT FOR ZIF SOCKET CONNECTOR

(75) Inventor: Genn-Sheng Lee, Tu-Chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/014,617

(22) Filed: Dec. 10, 2001

(51) Int. Cl.[7] ..... H01R 13/625
(52) U.S. Cl. ..... 439/342; 439/856
(58) Field of Search ..... 439/342, 856, 439/857, 259

(56) References Cited

U.S. PATENT DOCUMENTS 4,498,725 A * 2/1985 Bright et al.
6,113,411 A * 9/2000 Lu et al. ..... 439/342
6,171,156 B1 * 1/2001 Lin et al. ..... 439/342

* cited by examiner

*Primary Examiner*—Gary F. Paumen
(74) *Attorney, Agent, or Firm*—Wei Te Chung

(57) ABSTRACT

A ZIF socket connector (20) includes a base (22), a cover (24), an actuator (26) and a number of electrical contacts (30). The cover is movably assembled to the base and the base defines a plurality of openings extending therethrough to receive the electrical contacts. Each electrical contact has a retention portion (31), a solder portion (32) extending from the retention portion, a first arm (33) and a second arm (34). The first and the second arms extend upwardly from the retention portion and beside each other. The first arm has a beam section, a curved section and a free end. The second arm includes a leg section and a curved contacting section. The free end and the curved contacting section cooperate with each other to press therebetween and electrically connect with a pin of an electronic package received on the cover.

1 Claim, 8 Drawing Sheets

ELECTRICAL CONTACT FOR ZIF SOCKET CONNECTOR

BACKGROUND OF THE INVENTION

1. Field of the Invention

The present invention relates to an electrical connector, and particularly to a Zero Insertion Force (ZIF) socket connector for electrically interconnecting an electronic package, for example a Central Processing Unit (CPU), with a printed circuit board, for example a mother board.

2. Description of the Related Art

Referring to FIGS. 9 and 10, two drawing figures adapted from U.S. Pat. No. 4,498,725, an electrical contact 14 to be used in a ZIF socket connector (not shown) is disclosed. The electrical contact 14 includes two parallel, vertical arms 106 and 108. Channel-shaped strap 110 joins the two arms adjacent their lower ends 112 and spaces them apart. The width of the arms 106 and 108 decrease uniformly upwardly towards their upper ends 116. A pair of fingers 118 project laterally from their attachment to upper ends 116 of the arms 106 and 108. First sections 120 of the fingers 118 converge toward each other. Free ends 122, attached to and extending outward from the converging sections 120, are parallel to each other and are spaced apart by a distance less than the minimum diameter of pins (or leads, not shown) on an electronic package (not shown) to reliably and electrically connect with the pins when engaged. A lead 124 extends downwardly from the arm 106.

The contacts 14 are stamped out of coplanar stock in a continuous strip. Referring to FIG. 10, a carrier strip 130 is connected to the electrical contact 14 which has not yet been formed into the FIG. 9 structure. A lateral dimension p is defined between outer ends of the fingers 118 of each electrical contact 14, which determines a maximum lateral dimension of a blanked out electrical contact 14 and a minimal length of material needed to make the electrical contact 14. Since the arms 106, 108 with the fingers 118 are symmetrically configured with respect to each other, as is known to one of ordinary skill in the pertinent art, for providing dual contacting points to the pins of the electronic package to ensure an electrical connection therebetween, the lateral dimension p is at least twice of a lateral dimension p' of each arm 106, 108 defined between a center line c of the electrical contact 14 and the outer lateral end of the finger 118 and is comparatively larger than an acceptable data, for example 1.27 millimeter, thereby consuming a large quantity of material in manufacturing and increasing the cost of the electrical contacts 14, which is obviously not economical to contact manufacturers.

Therefore, a ZIF socket connector with a material-saving electrical contact is desired.

SUMMARY OF THE INVENTION

A major object of the present invention is to provide a cost effective electrical contact for a ZIF socket connector which provides also a reliable electrical connection between an electronic package and a printed circuit board.

A ZIF socket connector in accordance with the present invention comprises a base, a cover, an actuator and a plurality of electrical contacts. The cover is assembled to the base and is actuated by the actuator to be movable with respect to the base. The electrical contacts are received in the base. Each electrical contact comprises a retention portion, a solder portion extending from the retention portion, a first arm and a second arm extending beside the first arm. The first arm comprises a beam section extending from the retention portion, a curved section and a free end extending from the curved section toward the second arm. The second arm comprises a leg section and a curved contacting section extending from the leg section toward the first arm. The curved contacting section is aligned with the free end to cooperatively secure therebetween and electrically contact a pin of an electronic package received on the cover.

Other objects, advantages and novel features of the invention will become more apparent from the following detailed description of the present embodiment when taken in conjunction with the accompanying drawings.

DETAILED DESCRIPTION OF THE INVENTION

Figure 1:
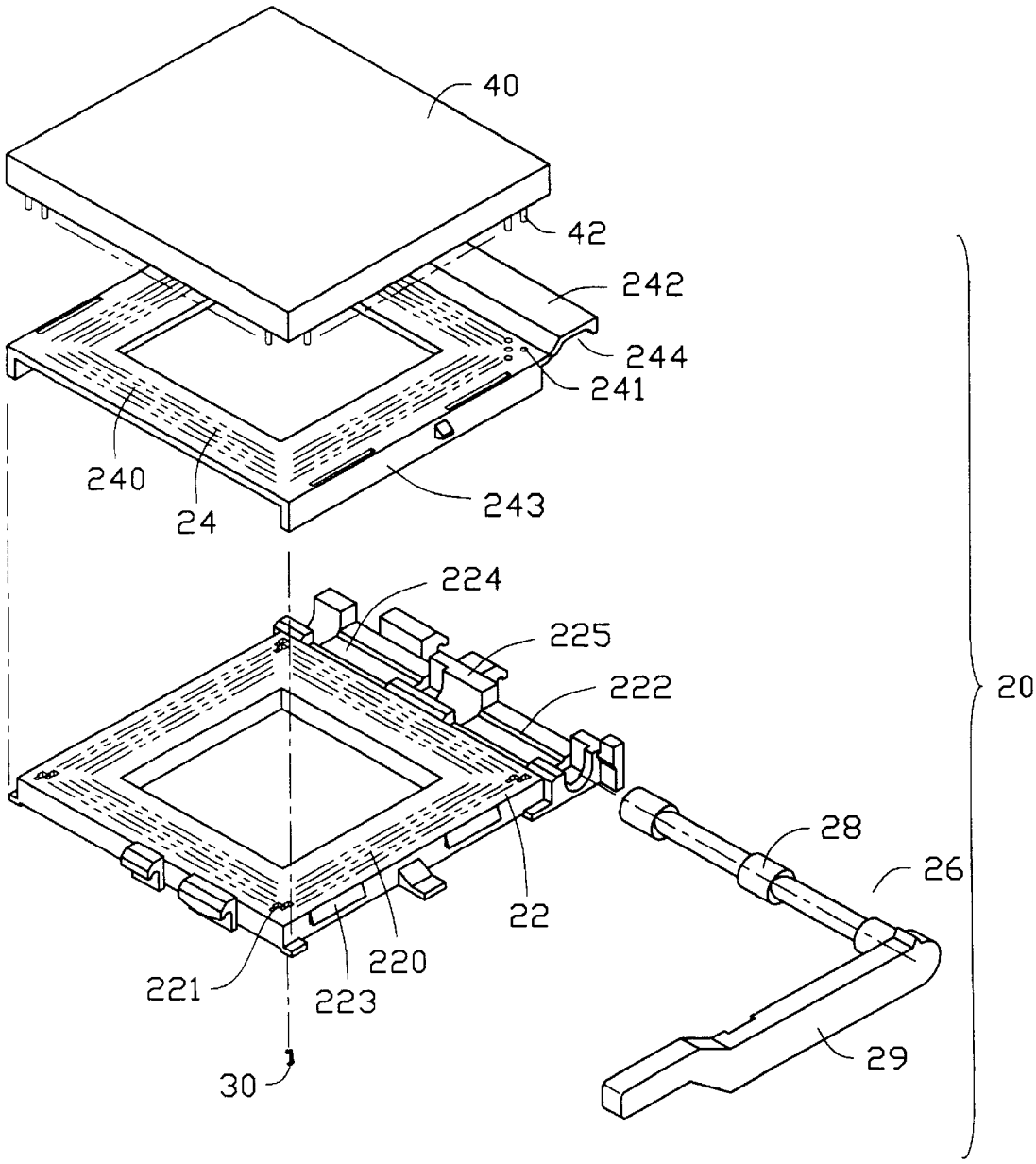
FIG. 1 is an exploded view of a ZIF socket connector employing electrical contacts in accordance with the present invention.
Figure 2:
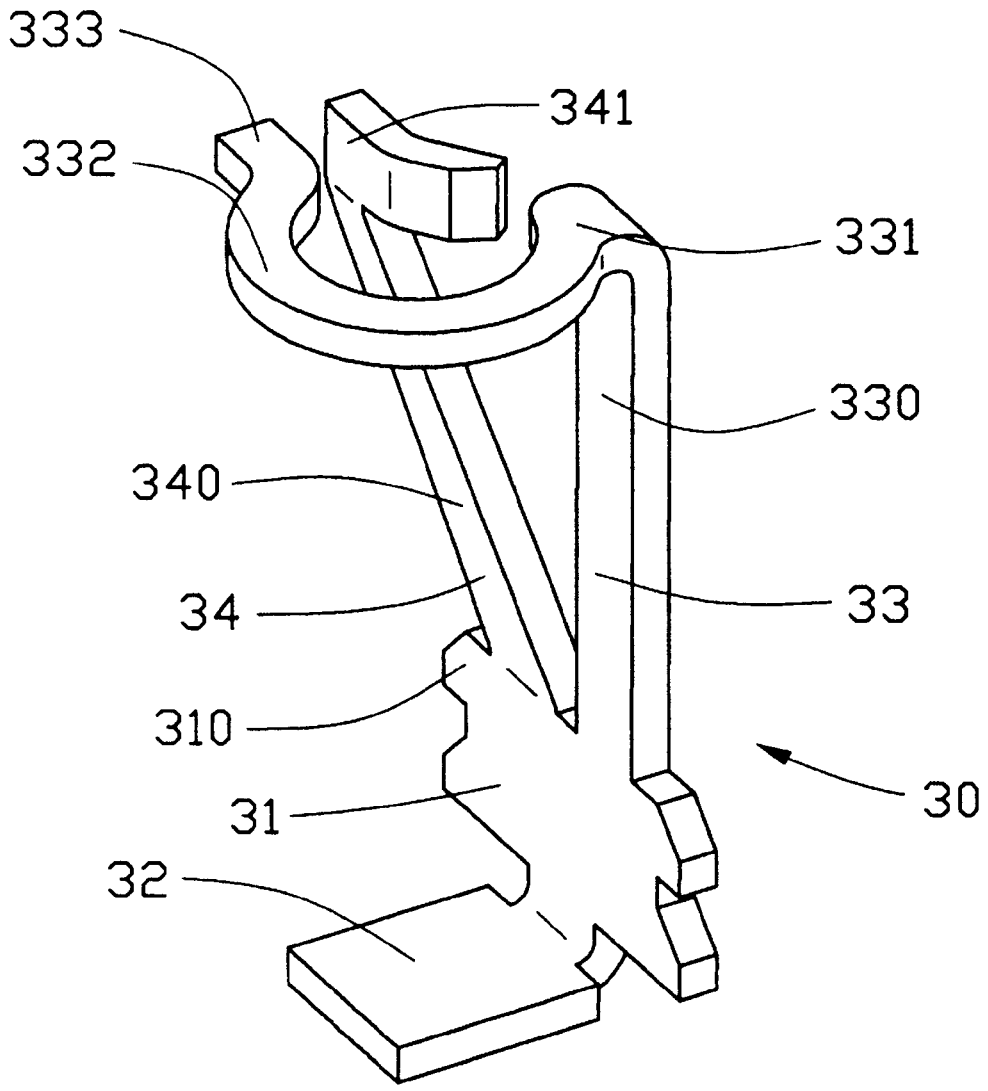
FIG. 2 is a perspective view of the electrical contact of the ZIF socket connector of FIG. 1.
Figure 3:
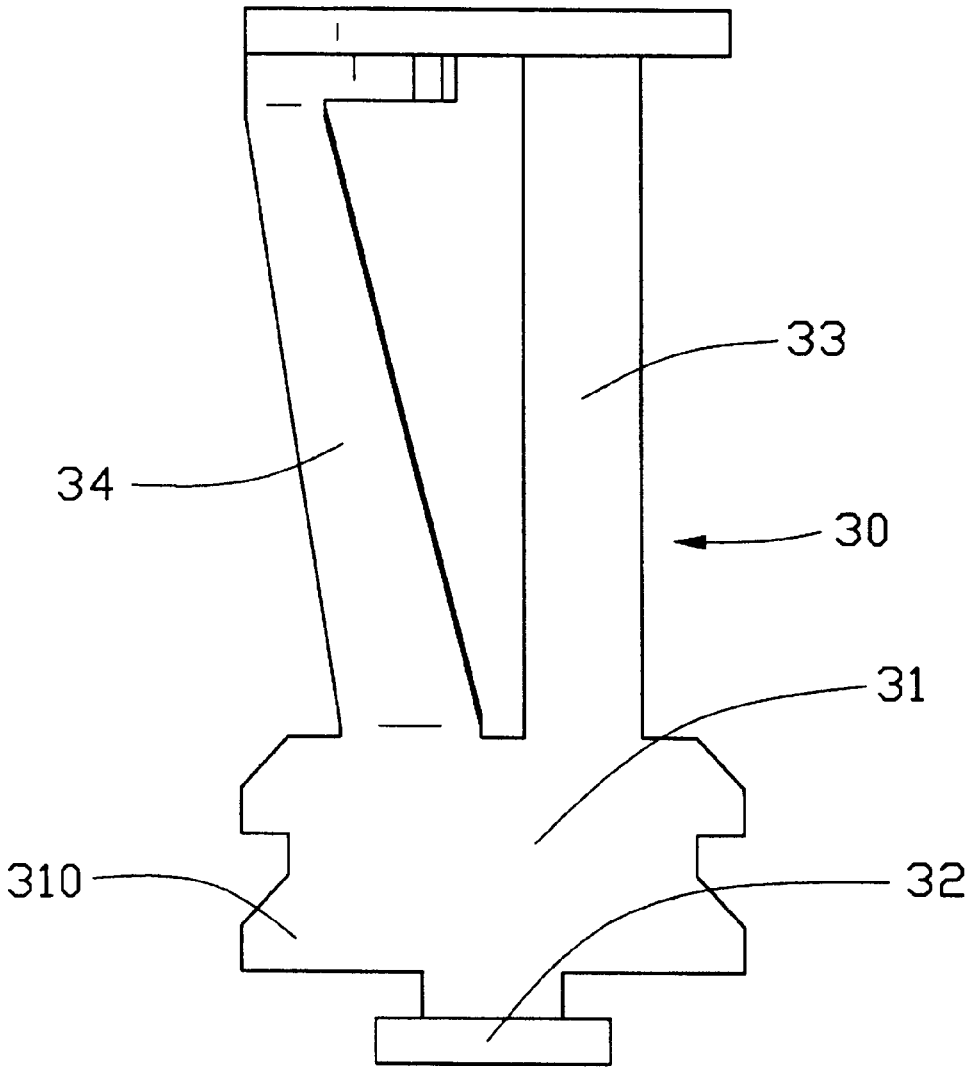
FIG. 3 is a front view of the electrical contact of the ZIF socket connector of FIG. 1.
Figure 4:
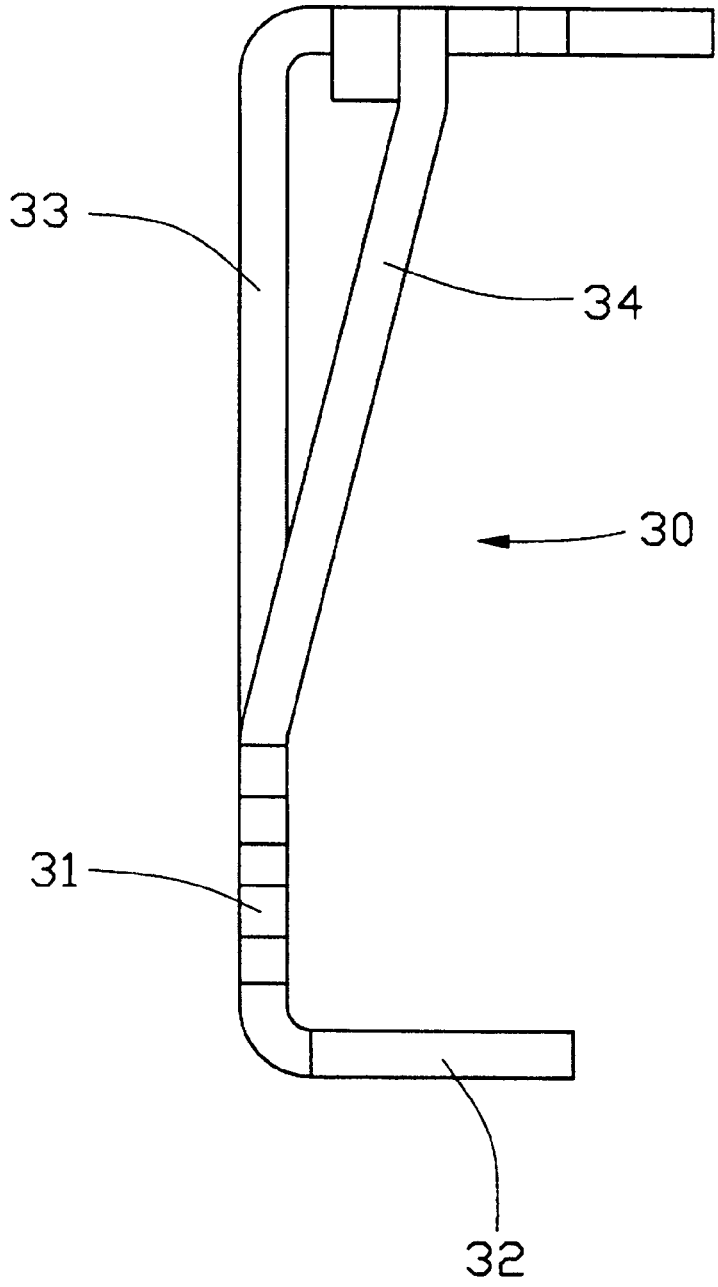
FIG. 4 is a side elevational view of FIG. 3.

Referring to FIG. 1, a ZIF socket connector 20 in accordance with the present invention is to electrically connect an electronic package 40 having a plurality of pins (leads) 42 extending downwardly with a printed circuit board (not shown). The ZIF socket connector 20 comprises a base 22, a cover 24, an actuator 26 and a plurality of electrical contacts 30.

The base 22 is generally rectangular in shape and includes a rectangular base frame 220 and an actuator accommodating portion 222 on a side of the base frame 220. The base frame 220 is formed with a plurality of openings 221 extending therethrough for receiving the electrical contacts 30 therein and a plurality of protrusions 223 extending outwardly from outer surfaces thereof. The actuator accommodating portion 222 defines a slot 224 and a plurality of blocks 225 beside the slot 224.

The cover 24 is to assemble with the base 22 and has a rectangular cover frame 240 and an actuator accommodating portion 242 on a side of the cover frame 240. The cover frame 240 and the actuator accommodating portion 242 align with the base frame 220 and the actuator accommodating portion 222 of the base 22, respectively. The cover frame 240 comprises a plurality of holes 241 extending therethrough and corresponding in number to the electrical contacts 30 received in the openings 221, a pair of flanges 243 extending downwardly, and a plurality of recesses (not shown) defined in inner surfaces of the flanges 243. The recesses of the cover frame 240 are engageable with the protrusions 223 of the base frame 220 so that the cover 24 is movably assembled to the base 22. The actuator accommodating portion 242 defines a groove 244 in a lower surface thereof to cooperate with the slot 224 to define a channel therebetween.

The actuator 26 comprises a lever 28 received within the channel defined by the slot 224 and the groove 244 and a handle 29 extending perpendicularly from an end of the lever 28. The actuator 26 could be in any other forms, as is known to one of ordinary skill in the pertinent art, used in all kinds of ZIF socket connectors, for example a cam extending in corners of the base and the cover, on the only condition that it can be manipulated to move the cover with respect to the base in use.

Referring to FIGS. 2–5, each electrical contact 30 comprises a planar retention portion 31, a solder portion 32 extending from a lower center section of the retention portion 31, a first arm 33 extending upwardly from an upper section of the retention portion 31 and a second arm 34 extending forwardly and upwardly from the retention portion 34 and beside the first arm 33. The retention portion 31 is formed with a plurality of barbs 310 extending outwardly from laterally opposite sides thereof to engage with inner walls (not shown) of the openings 221 of the base 22, thereby securing the electrical contacts 30 in the openings 221, respectively. The first and the second arms 33, 34 extend from a same side of the retention portion 31 and the solder portion 31 extends from an opposite side of the retention portion 31. The solder portion 31 is generally rectangular and perpendicular to the retention portion 31, and could be in any configurations as desired to be mounted to a printed circuit board (not shown) to which the ZIF socket connector 20 is mounted.

The first arm 33 comprises a beam section 330 extending upwardly directly from the retention portion 31, a forwardly bent section 331 extending from an upper end of the beam section 330, a curved section 332 extending from the forwardly bent section 330, a free end 333 extending substantially parallel to the retention portion 31 and a transitional section 334 connecting the free end 333 and the curved section 332. The curved section 332 extends in a plane generally perpendicular to the beam section 330 and is so configured that a separating face 335 of the free end 333, along which the first arm 33 is separated from waste materials (not shown) between the first and the second arms 33, 34, extends vertically and faces toward the second arm 34.

The second arm 34 includes a leg section 340 extending forwardly and upwardly from the retention portion 31 and beside the beam section 330 of the first arm 33 and a curved contacting section 341 extending laterally from an upper end of the leg section 340 toward the beam section 330 of the first arm 33. A width of the leg section 340 decreases upwardly toward the curved contacting section 341. The curved contacting section 341 of the second arm 34 is substantially aligned with and faces the separating face 335 of the free end 333 of the first arm 33 and a distance between the separating face 335 of the free end 333 and the curved contacting section 341 is substantially smaller than a minimum diameter of the pin 42 of the electronic package 40.

Figures 5, 6, 7:
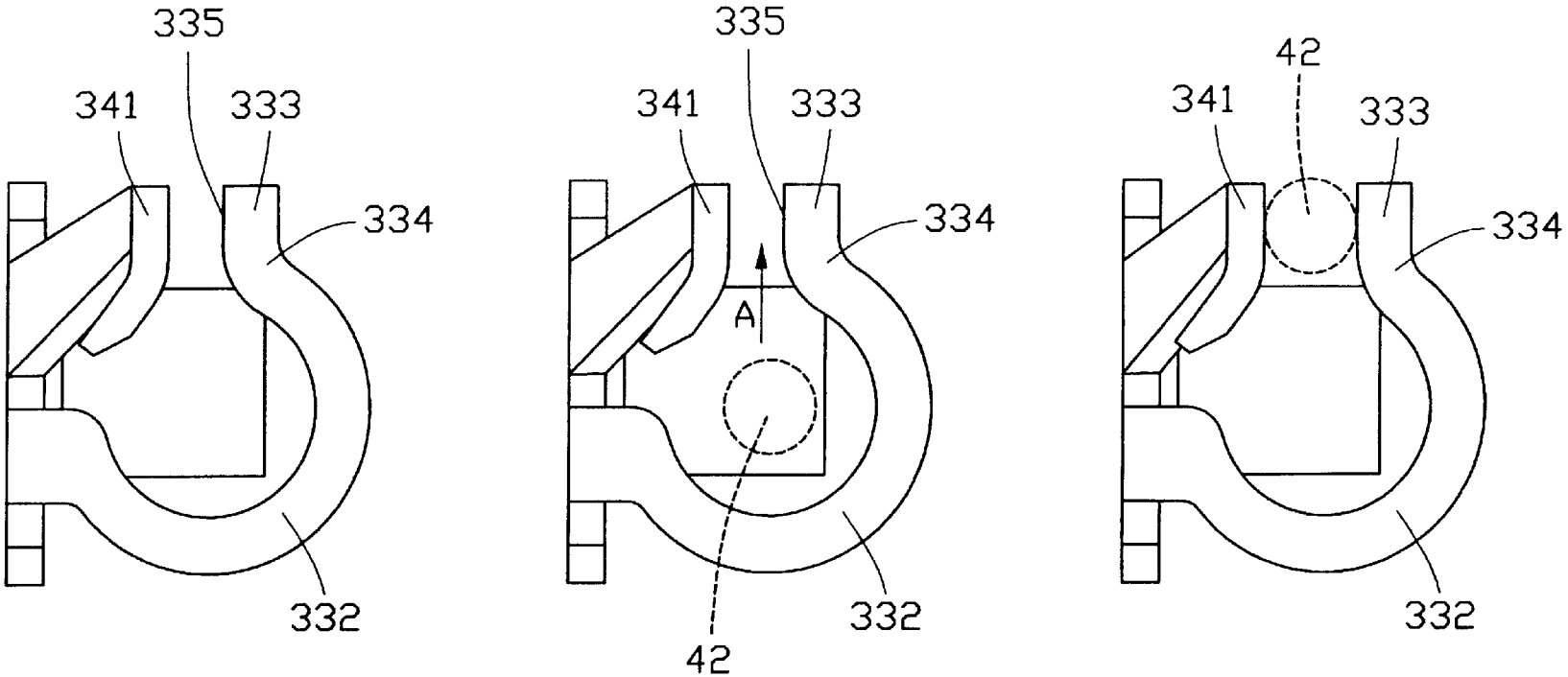
FIG. 5 is a top plan view of FIG. 3.
FIG. 6 is a view similar to FIG. 5, showing that a pin of an electronic package is received but not contacted with the electrical contact.
FIG. 7 is a view similar to FIG. 6 but the pin of the electronic package is contacted with the electrical contact.

When the electronic package 40 is initially disposed on the cover 24, the pins 42, as is the case with all ZIF socket, extend through the holes 241 of the cover 24 into the openings 221 of the base 22 without electrically contacting with the electrical contacts 30. Referring to FIG. 6, the pin 42 is located in a space confined by the curved section 332 of the first arm 33.

The cover 24 with the electronic package 40 is then actuated by the cooperation of the blocks 225 of the base 22 and the lever 28 of the actuator 25, which is in turn actuated by the handle 29, to move on the base 22 and to move the pins 42 in the direction as indicated by the arrow A in FIG. 6. Referring to FIG. 7, the pin 42 is finally located between the separating face 335 of the free end 333 of the first arm 33 and the curved contacting section 341 of the second arm 34 and electrically connects therewith. Since the distance between the separating face 335 of the free end 333 of the first arm 33 and the curved contacting section 341 of the second arm 34 is substantially smaller than the diameter of the pin 42, the pin 42 is reliably compressed between the first and the second arms 33, 34 and an electrical connection therebetween is ensured.

Figure 8:
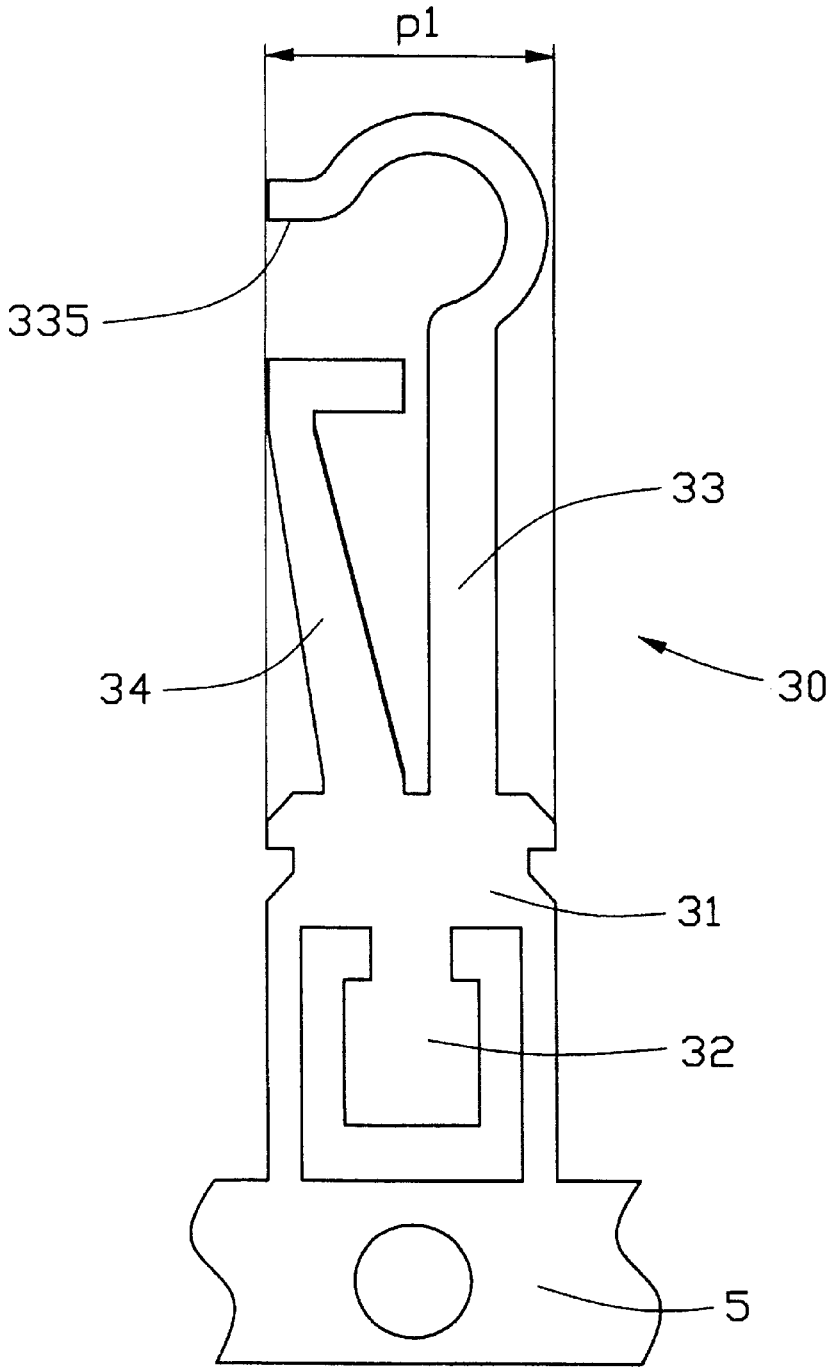
FIG. 8 is a plan view of the electrical contact with only a curved section of a first arm thereof having been formed.
Figure 9:
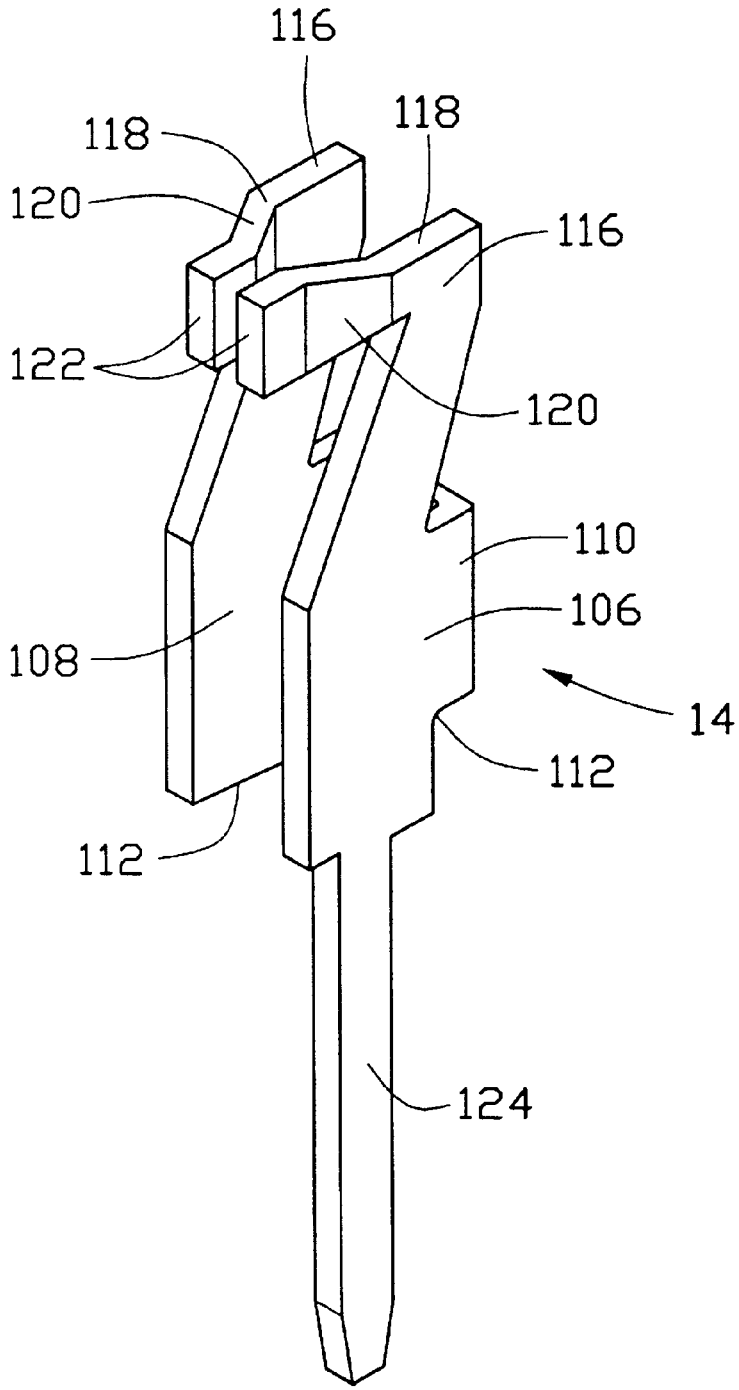
FIG. 9 (PRIOR ART)
FIG. 9 is a perspective view of a prior art electrical contact.
Figure 10:
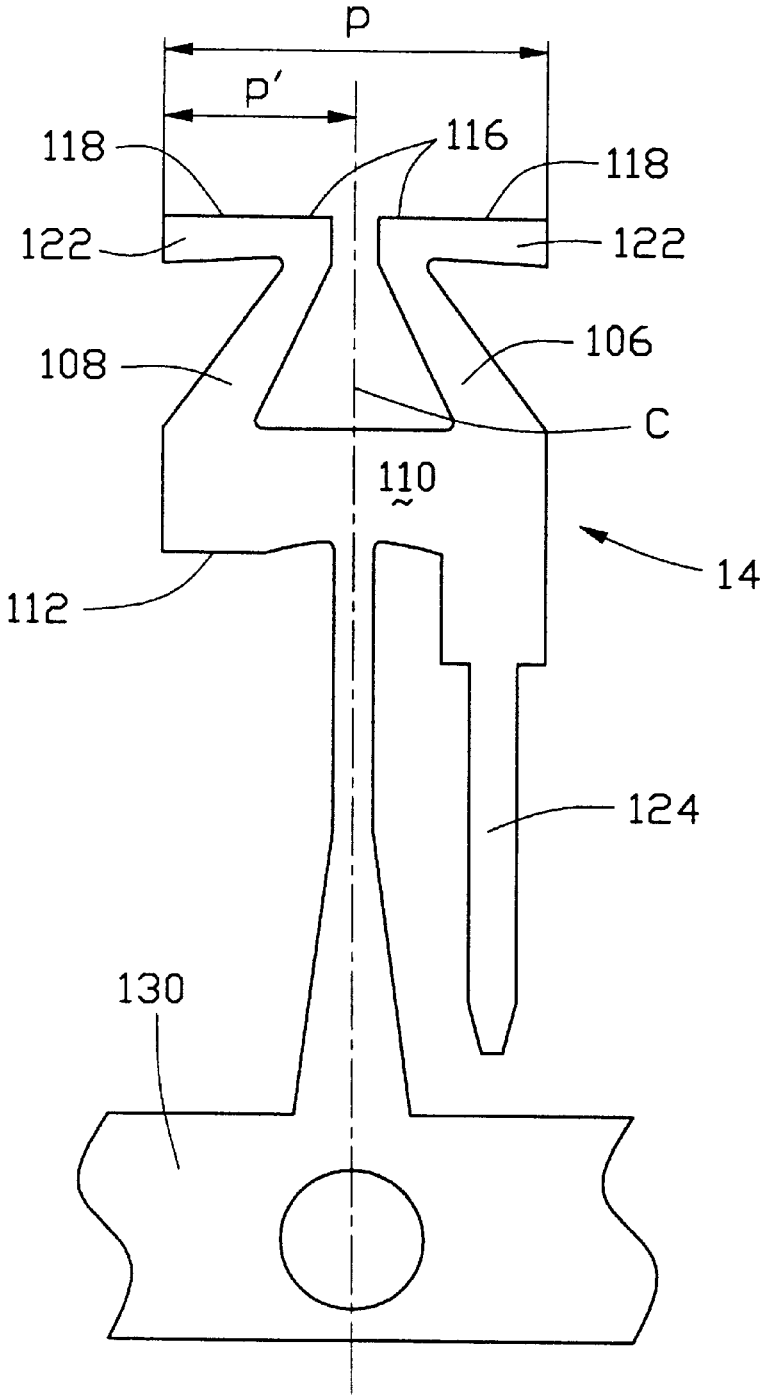
FIG. 10 (PRIOR ART)
FIG. 10 is a blanked-out electrical contact of FIG. 9 prior to being formed.

Referring also to FIG. 8, the electrical contact 30 is as shown connected to a carrier 6, a lateral dimension p1 of the electrical contact 30 defined between opposite outer lateral ends thereof and exemplified herein between outer lateral ends of the retention portion 31 thereof, which determines a maximal lateral dimension of the electrical contact 30 and a minimal length of material to make the electrical contact 30, is smaller than an acceptable data, such as 1.27 millimeter due to the dissymmetry relation between the first and the second arms 33, 34, thereby saving the material from which it is made and reducing the manufacturing cost thereof. The electrical contact 30 electrically contacts the pin 42 at the separating face 335 of the free end 333 and the curved contacting section 341, thereby further reducing the lateral dimension p1 and ensuring an electrical connection therebetween.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A ZIF socket connector adapted for electrically connecting with an electronic package having a plurality of pins, comprising:

a base defining a plurality of openings extending therethrough;

a cover being assembled to the base and being adapted to receive thereon an electronic package having a plurality of pins;

an actuator being assembled to the base and the cover and moving the cover with respect to the base; and a plurality of electrical contacts received in the openings of the base, each electrical contact comprising a vertical retention portion to retain to the opening of the base and extending in a vertical plane with retention means thereon; a solder portion extending from a bottom edge of said retention portion;

first and second arms side by side upwardly extending from said retention portion and engaging a corresponding pin of the electronic package;

said first arm including a first section extending from an upper section of said retention portion, a second section extending from said first section with a free end thereof;

said second arm including a leg section extending upwardly from the upper section of said retention portion, a contact section extending from said leg section;

said contact section and said free end being located on the same side of said vertical plane and substantially located at a same level with a vertical dimension relative to the upper section while said free end is spaced from said vertical plane by a first lateral dimension and the contact section is spaced from said vertical plane with a second dimension smaller than said first dimension;

wherein said first and second sections cooperatively define said vertical and first lateral dimensions while said leg section defines said vertical and second lateral dimension;

wherein said first section extends upwardly from said upper section and said second section extends laterally from said first section, wherein said second section extends horizontally and is located at the same level with the contact section;

wherein said first section is coplanar with said vertical plane;

wherein said free end substantially extends in a horizontal direction parallel to said vertical plane;

wherein said second section extends in generally an arc configuration;

wherein the arc configuration extends beyond the first arm in a direction opposite to said horizontal direction;

wherein the cover defined a plurality of holes corresponding in number to the openings of the base and to the electrical contacts for the pins of the electronic package to extend therethrough into the openings of the base;

wherein the retention portion of each electrical contact is formed with a plurality of barbs to engage with the opening of the base.

* * * * *